United States Patent [19]

Schlichting et al.

[11] 4,057,033

[45] Nov. 8, 1977

[54] INDUSTRIAL TECHNIQUE

[75] Inventors: John Schlichting, Lynchburg, Va.; Robert Norman Tornow, Clinton, Ohio

[73] Assignee: The Babcock & Wilcox Company, New York, N.Y.

[21] Appl. No.: 602,941

[22] Filed: Aug. 8, 1975

[51] Int. Cl.[2] ..... F22B 1/06; F22D 1/00

[52] U.S. Cl. ..... 122/32; 122/438

[58] Field of Search ..... 122/32, 33, 34, 436, 122/438

[56] References Cited

U.S. PATENT DOCUMENTS

| | | | |
|---|---|---|---|
| 210,846 | 12/1878 | Ford | 122/436 |
| 232,342 | 9/1880 | Fulton | 122/438 |
| 3,262,428 | 7/1966 | Romanos | 122/34 |
| 3,483,848 | 12/1969 | Green | 122/32 |
| 3,635,287 | 1/1972 | Sprague | 122/32 |
| 3,661,123 | 5/1972 | Romanos | 122/32 |
| 3,766,892 | 10/1973 | Webster | 122/32 |
| 3,916,843 | 11/1975 | Bennett | 122/32 |

FOREIGN PATENT DOCUMENTS

| | | | |
|---|---|---|---|
| 401,288 | 10/1933 | United Kingdom | 122/236 |

*Primary Examiner*—Kenneth W. Sprague
*Attorney, Agent, or Firm*—J. Maguire; R. J. Edwards

[57] ABSTRACT

An illustrative embodiment of the invention eliminates the circumferential thermal stresses found in a feedwater inlet nozzle of a once-through-vapor generator that are caused by the presence of steam in the nozzle during a low flow load condition. Specifically, The cold inlet feedwater is directed upwardly to fill and overflow the nozzle conduit and prevent steam entrance and collection in the nozzle, and then, impinges on a shroud which re-directs the flow downward into fluid flow contact with the nozzle conduit and through the vapor generator.

4 Claims, 3 Drawing Figures

INDUSTRIAL TECHNIQUE

BACKGROUND OF THE INVENTION

1. FIELD OF THE INVENTION

This invention relates to heat exchangers, and more particularly, to techniques for reducing circumferential thermal gradients along the length of the feedwater inlet nozzle.

2. DESCRIPTION OF THE PRIOR ART

Transferring heat from one fluid to another is a common industrial operation. Refineries and chemical processing plants, as well as nuclear and conventionally fueled power plants are typical of the many different installations that make a widespread use of the heat exchanging equipment that is generally required to perform this function.

In a pressurized water nuclear power plant, for instance, a primary coolant fluid extracts heat from the reactor. This hot fluid is circulated to the inlet head of a heat exchanger. In this connection, the associated heat exchanger ordinarily has an inlet and an outlet head, respectively, for receiving and discharging the primary coolant. A bundle or bank of tubes provides primary coolant fluid communication between these two heads. The extreme ends of these tubes, moreover, are customarily anchored in flat tube sheets that serve as closures for the individual heads.

A pressure shell encloses the tube bundle in order to establish a chamber in which a secondary coolant fluid, flowing between the inside surface of the pressure shell and the outer surfaces of the tubes absorbs heat from the primary coolant that is within these tubes. The secondary coolant, usually admitted to this chamber through feedfluid inlets, after absorbing heat from the primary coolant is discharged from the heat exchanger through outlets for distribution to the electrical power generation equipment within the plant.

Because the primary coolant usually is under a pressure that is in excess of 2,000 pounds per square inch, many of the structural portions of the heat exchanger which are subjected to this high pressure necessarily must be formed from thick steel sections. This is especially noticeable in the tube sheets. Each tube sheet, for example, might be pierced by more than 15,000 holes in order to receive and secure the individual tubes in the associated bundle. To provide adequate structural integrity in these circumstances, the tube sheets can be as much as 24 inches thick.

The differences in the primary and secondary coolant temperatures that are experienced within the heat exchanger, however, tend to produce thermal gradients which result in thermal stresses. Thus, for example, the temperature difference that is established between the relatively cold secondary coolant from the feedwater inlet nozzle on one side of a tube sheet, and the higher temperature primary coolant on the other side of the tube sheet, can produce unrelieved forces of great magnitude.

This physical phenomenon, moreover, appears in the feedwater inlet spray nozzles commonly found in heat exchangers of the once-through vapor generating type. In this type of heat exchanger, the inlet feedwater nozzles are disposed within an annular flow path between the vapor generating chamber and the heat exchanger shell. Moreover, "bleed steam" withdrawn from the vapor generating chamber is introduced into the annulus to mix with and heat the feedfluid being discharged from a spray plate disposed in the bottom of the nozzles. Thermal gradients and thermal stresses resulting therefrom are particularly aggravated in the inlet nozzles of this type vapor generator during certain operating conditions which either subject the inlet nozzles to large feedwater temperature changes or low feedwater flow rates. Thus, for example, when the heat exchanger is operating at a low flow condition, the nozzles are only partially filled with cold secondary coolant or feedwater. Moreover, the low flow condition allows the "bleed steam" present in the annulus to enter the inlet feedwater nozzles through the bottom located spray plate and congregate in the upper regions of the nozzle. If the temperature difference between the steam in the upper regions of the nozzle and the feedwater in the lower regions is sufficiently great, excessive circumferential thermal gradients occur along the length of the nozzle which result in potential thermal stress problems and reduced fatique life of the nozzle.

In addition, although the vapor generator has been adequately protected from thermal stresses due to large temperature changes of the inlet feedwater, the feedwater nozzle, and more particularly, the nozzle to flange juncture to the vapor generator shell has not been protected. Because this nozzle juncture has not been thermally protected, a minimum inlet feedwater temperature of about 185° F has been imposed on the heat exchanger system, rather than, the normal expected temperature of about 90° F.

Accordingly, the present inlet feedwater nozzles have placed limitations on the operating conditions of the feedwater system with respect to the low flow rates and the minimum inlet feedwater temperatures. Therefore, there is a need to provide industry with a solution to the problem of heat exchanger nozzle thermal gradients at low flow conditions and at lower inlet feedwater temperatures.

SUMMARY OF THE INVENTION

These difficulties are overcome, to a large extent, through the practice of the invention. Illustratively, the inlet feedwater nozzles are each provided with a nozzle shroud to eliminate circumferential thermal gradient buildup in the nozzle at low flow rates and a thermal sleeve-flange juncture to protect the nozzle from the thermal stresses resulting from large feedwater temperature changes.

Specifically, a heat exchanger embodying principles of the invention has at least one main feedfluid inlet nozzle that discharges into the annulus formed between the vapor generating chamber and the heat exchanger shell. The arrangement of the nozzle, moreover, includes an inlet pipe having a feedfluid discharge port or inlet nozzle located on the top of the inlet pipe, such that the feedfluid fills the inlet pipe and is discharged upwardly within the annulus. A shroud or spray plate, disposed above the discharge port then induces the inlet flow downwardly through the annulus to the vapor generating chamber.

More specifically, a heat exchanger feedfluid nozzle according to this invention includes a first inlet feedfluid nozzle located on the top of the inlet pipe, within and surrounded by a shroud having a second inlet feedfluid nozzle or spray plate. The inlet feedfluid, even at low flow rates, fills the inlet pipe and overflows into and fills the shroud before exiting through the spray plate. Accordingly, the feedfluid nozzle shroud system remains at the inlet feedfluid temperature since it is completely filled with feedfluid at all operating conditions. Furthermore, by proper design, the lowest flow rate which establishes this "full" or feedfluid temperature condition of the nozzle is significantly lower than the low flow rates presently employed.

In a further embodiment of the invention, the feedfluid inlet pipe is shrouded at the nozzle end to prevent circumferential thermal gradients about the nozzle, and is encircled at the shell-flange juncture end by a thermal sleeve disposed between the inlet pipe and the shell and/or flange. In this manner, not only is it possible to utilize lower flow rates than presently employed in current nozzles, but also, the inlet feedfluid minimum temperature may be greatly reduced due to the thermal sleeve protection at the pipe-flange juncture.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which there is illustrated and described a preferred embodiment of the invention.

DETAILED DESCRIPTION OF THE PREFERRED EMBODIMENTS OF THE INVENTION

For a more complete appreciation of the invention, attention is invited to the following description of an illustrative embodiment of the invention, as shown in the attached drawings.

Figure 1:
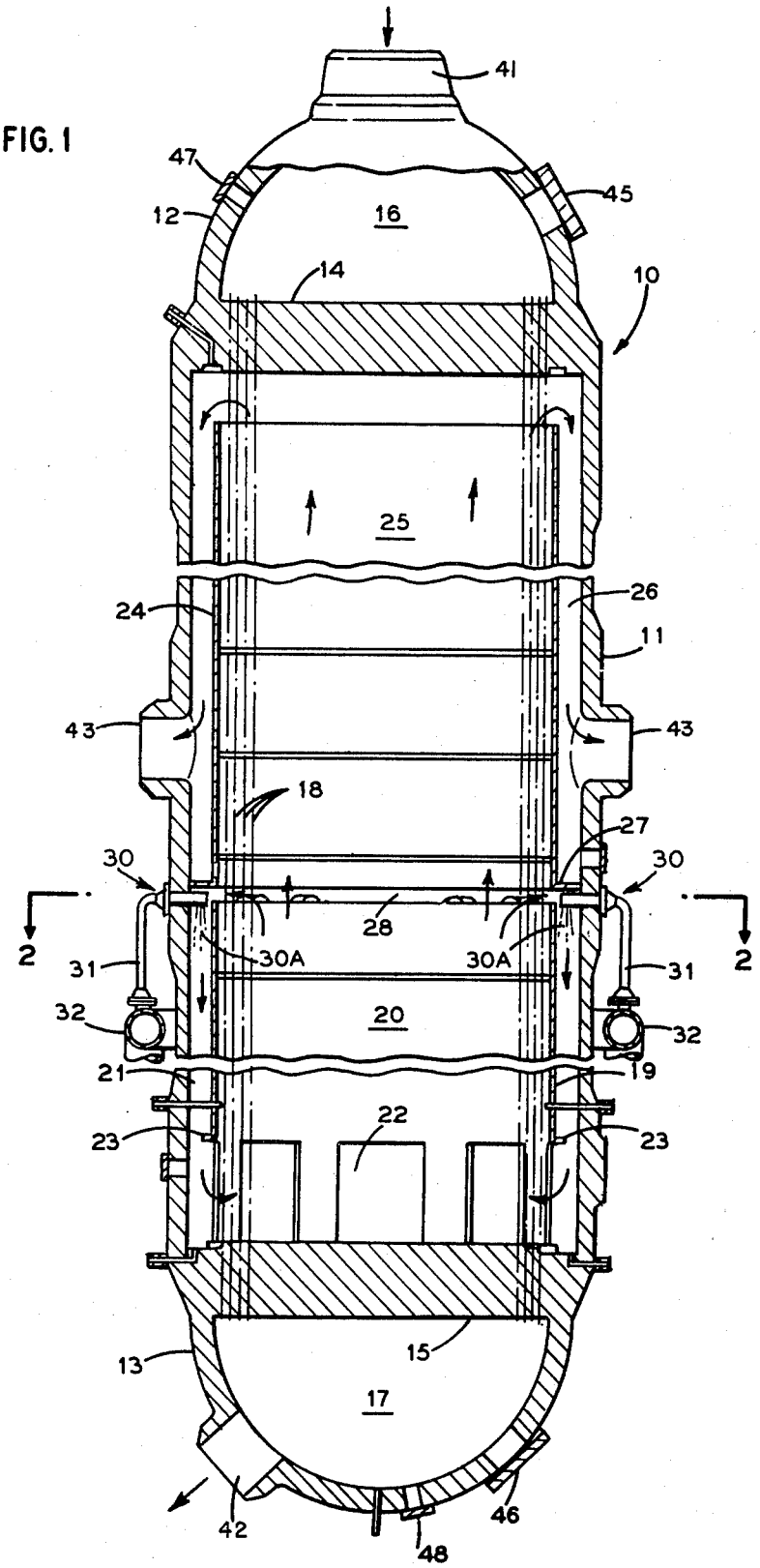
FIG. 1 is a sectional view of a once-through vapor generator embodying the invention.

FIG. 1 illustrates a heat exchanger in the form of a once-through vapor generating and superheating unit 10 comprising a vertically elongated cylindrical pressure vessel 11 closed at its opposite ends by an upper head member 12 and a lower head member 13. The vessel 11 is transversely divided by upper and lower tube sheets 14 and 15 respectively. The upper tube sheet 14 is integrally attached to vessel 11 and upper head member 12 and forms in combination with the upper head member a fluid inlet chamber 16. The lower tube sheet 15 is integrally attached to vessel 11 and lower head member 13 and forms in combination with the lower head member a fluid outlet chamber 17.

A multiplicity of straight tubes 18 arranged to form a tube bank extend vertically between the upper and lower tube sheets 14 and 15 and penetrate through both tube sheets to interconnect the fluid inlet chamber 16 with the fluid outlet chamber 17. A cylindrically shaped lower shroud member 19 surrounds the tubes 18 and extends upwardly from the upper face of the lower tube sheet 15 and terminating at a plane intermediate the height of vessel 11. This lower shroud defines the lower portion of an inner passage or steam generating riser chamber 20 which contains the lower portion of tubes 18 and cooperates with the vessel 11 to form the lower portion of a circumscribing annular shaped outer passage, annulus, or inlet compartment 21. Openings 22 circumferentially spaced about the lower portion of shroud 19 provide flow communication between the inlet compartment 21 and the riser chamber 20. An adjustable circular segmental plate orifice 23 projects outwardly from the shroud 19 at approximately the level of the top edge of openings 22.

A cylindrically shaped upper shroud member 24 extends upwardly from a plane closely spaced above the upper edge of lower shroud 19 to a plane located below the upper tube sheet 14. This upper shroud 24 forms the upper portion of an inner passage or steam generating and superheating chamber 25 and being an extension of chamber 20, contains the upper section of tubes 18. The shroud 24 in cooperation with the vessel 11 forms the upper portion of an annular shaped outer passage or outlet compartment 26. The lower end of compartment 26 is sealed closed by an annular plate 27 welded about its outer edge to the vessel 11 and around its inner edge to the shroud 24. The open space 28 between the top edge of shroud 19 and the bottom plate 27 of shroud 24 is in flow communication with the inlet compartment 21.

At the upper end of the inlet compartment 21, a plurality of main feedfluid nozzles 30 extend through the wall of vessel 11 with their respective outlet ends discharging into the inlet compartment 21 near or at the same level as the open space 28 and as shown by the spray pattern at 30A. Connecting pipes 31 join nozzles 30 to a ring shaped main feedfluid header 32 which encircles the vessel 11 below the nozzles 30.

The upper head member 12 is provided with an inlet connection 41 for admitting heating fluid to chamber 16 while lower head member 13 is provided with an outlet connection 42 for discharging the heating fluid from chamber 17. The vessel 11 includes outlet connections 43 for delivering the superheated vapor to the point of use, and the upper and lower heads 12 and 13 are customarily provided with manways 45 and 46 and inspection ports 47 and 48 respectively.

Figure 2:
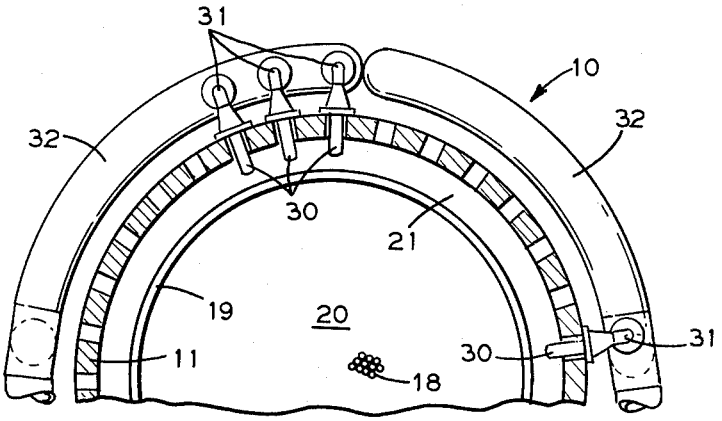
FIG. 2 is a partial section taken along line 2—2 in FIG. 1.

FIG. 2 illustrates a transverse section of the once-through vapor generating and superheating unit 10 taken at section 2—2 of FIG. 1, i.e., at the main feedfluid inlet to the unit and including the multiple main feedfluid nozzles 30, only four of which are actually shown, spaced circumferentially about the vessel 11 and extending through the vessel wall to discharge downward into the inlet compartment 21. A main feedfluid header 32, made up of two separate arcuate sections, supplies fluid through the connecting pipes 31 to the nozzles 30 for discharge into compartment 21. The lower shroud member 19 defines the outer periphery of the lower portion of the inner passage or riser chamber 20 which houses the lower length section of tubes 18.

Figure 3:
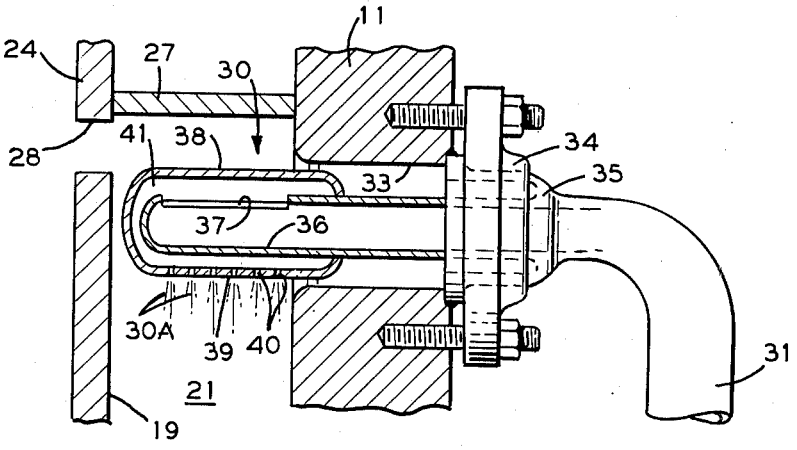
FIG. 3 is an enlarged sectional view of the inlet nozzle of FIG. 1.

FIG. 3 illustrates a sectional elevation view of an inlet nozzle 30 of the once-through vapor generator 10. The nozzle 30 is shown extending through an aperture 33 in the vessel 11, disposed within the inlet compartment 21 and attached to the vessel 11 by a flange 34. Disposed between the connecting pipe 31 and the flange 34 and, also, between the connecting pipe 31 and the vessel 11 is a thermal sleeve 35, generally open to the aperture 33 at one end and closed at the other end.

The nozzle 30 is provided with an inner pipe 36 having a feedfluid opening or discharge port 37 located along the top of the pipe to discharge the feedfluid in a vertically upward direction. Further, disposed above the inner pipe 36 is a nozzle shroud 38 which re-directs the upwardly discharged feedfluid in a downward direction as indicated by the spray pattern 30A. Moreover, in the embodiment of the invention described and shown herein, the nozzle shroud 38 completely encloses the inner pipe 36 forming an annulus 41 therebetween. In addition, the bottom of the nozzle shroud is formed in the shape of a spray plate 39 having a plurality of holes 40 therein which produce a desired inlet feedfluid spray pattern 30A in the downward direction.

During normal operation of the vapor generator, primary coolant received from a pressurized water reactor or a similar source, not shown, is supplied to the upper chamber 16 through the inlet connection 41. The primary coolant gives up heat to a secondary fluid during passage through the tubes 18 of vapor generator 10 and thus will hereinafter be referred to as the heating fluid. From chamber 16, the heating fluid flows downwardly through the tubes 18 into the lower chamber 17 and is discharged from the vapor generator through the outlet connection 42. The feedfluid supplied to the header 32 from whence it is discharged through the nozzles 30 into the upper end of the inlet compartment 21 of the vapor generator, flows downwardly through the inlet compartment 21 and past the adjustable orifice 23 and through the shroud openings 22 into the riser chamber 20. The main feedfluid enters the riser chamber 20 at substantially saturation temperature and vapor generation commences immediately. It flows upwardly about the tubes in counterflow and indirect heat transfer relationship with the heating fluid flowing within the tubes 18. A portion of the main feedfluid in the form of vapor at substantially 100 percent quality is withdrawn from the top of shroud 19 and passed through the open space 28 to mix with and heat the main feedfluid being discharged from the nozzles 30. As this vapor mixes with the incoming feedfluid, it condenses resulting in a slight reduction in pressure which provides an aspirating effect causing the withdrawal of vapor from within the chamber 20 into the inlet compartment 21. The withdrawn vapor gives up its latent heat of vaporization to the incoming feedfluid with the mixture being heated substantially to saturation temperature. That portion of vapor which has not been withdrawn is passed upwardly through the superheating chamber 25 and is super-heated before it reverses direction about the upper shroud 24. It then flows downwardly through the outlet compartment 26 between the upper shroud and the shell and finally exits from the unit through the vapor outlet connections 43.

A nozzle 30, in accordance with this invention eliminates the circumferential thermal gradients found in presently existing nozzles at low flow rates, and thereby, increases the nozzles fatigue life. Accordingly, as shown in this particular embodiment of the invention, the nozzle 30, and more particularly, the inner pipe 36 and the annulus 41 formed by the nozzle shroud 38 and the pipe 36 are completely filled with flowing—discharging inlet feedfluid. More specifically, the inlet feedfluid is upwardly discharged into flow contact with the shroud 38, fills the annulus 41 overflows the pipe 36 and discharges outwardly from the nozzle in a downward direction into the inlet compartment 21. Moreover, since the nozzle 30 is completely filled with flowing feedfluid, circumferential thermal gradients, formed by temperature differences within the nozzle, do not exist. Furthermore, even at low flow rates or flow conditions, that is, at all practical heat exchanger flow conditions, the feedfluid discharges upwardly into the annulus, into contact with the shroud, overflow the inner pipe 36 and discharges through the spray holes 40. Accordingly, since the feedfluid fills the nozzle at all flow rates, that is, even at low flow rates, bleed steam is precluded from entering the nozzle and establishing a high temperature steam zone amongst the low temperature feedfluid with the resulting circumferential thermal gradients found in the presently existing nozzles.

Of course, it is clear that there are flow conditions which barely fill and/or overflow the inner pipe 36. However, such flow conditions are practically, if not actually, non-flowing conditions or shut down situations of no interest, since they are of no practical or actual use in vapor generation as herein described.

In accordance with the present invention, lower flow rates than that which are presently obtainable in existing nozzles, are obtainable without the generation of the circumferential thermal gradients found in the existing nozzles.

What is claimed is:

1. A heat exchanger comprising an upright pressure vessel, a plurality of tubes extending through the vessel, shroud means surrounding the tubes to form a vapor generating and superheating passage and cooperating with the vessel to form inlet and outlet passages communicating with the vapor generating and superheating passage, means for directing a heating fluid through the tubes, means for introducing and serially directing a feedfluid in through the inlet passage, through the vapor generating and superheating passage in indirect heat exchange relation with the heating fluid, and out through the outlet passage, means for withdrawing a portion of the vaporized feedfluid from the vapor generating and superheating passage for mixing with the feedfluid entering the inlet passage, and wherein the means for introducing feedfluid into the inlet passage includes a plurality of spaced coplanar nozzles discharging into the inlet passage, each of the nozzles comprising horizontally disposed inner and outer tubular members having closed adjacent end faces and cooperating with one another to form an enclosed chamber therebetween, the inner tubular member having outlet means extending along the top thereof for discharging feedfluid into the chamber, and the outer tubular member having outlet means extending along the bottom thereof for discharging feedfluid from the chamber to said inlet passage.

2. The heat exchanger according to claim 1 including the outlet means of said inner tubular member being in the form of an elongated slot.

3. The heat exchanger according to claim 1 including the outlet means of said outlet tubular member being in the form of a plurality of axially spaced perforations.

4. The heat exchanger according to claim 1 including flange means for mounting the nozzle to the vessel, and a thermal sleeve disposed at the juncture of said nozzle and flange means.

* * * * *